US011662690B2

(12) United States Patent
Huot-Marchand

(10) Patent No.: US 11,662,690 B2
(45) Date of Patent: May 30, 2023

(54) METHOD FOR MANUFACTURING AT LEAST TWO MECHANICAL PARTS

(71) Applicant: ETA SA MANUFACTURE HORLOGÈRE SUISSE, Grenchen (CH)

(72) Inventor: Sylvain Huot-Marchand, Le Locle (CH)

(73) Assignee: ETA SA MANUFACTURE HORLOGÈRE SUISSE, Grenchen (CH)

( * ) Notice: Subject to any disclaimer, the term of this patent is extended or adjusted under 35 U.S.C. 154(b) by 386 days.

(21) Appl. No.: 17/095,115

(22) Filed: Nov. 11, 2020

(65) Prior Publication Data

US 2021/0191326 A1 Jun. 24, 2021

(30) Foreign Application Priority Data

Dec. 18, 2019 (EP) ..... 19217598

(51) Int. Cl.
*G04B 15/14* (2006.01)
*G04C 3/04* (2006.01)
*G04C 5/00* (2006.01)

(52) U.S. Cl.
CPC ..... *G04B 15/14* (2013.01); *G04C 3/047* (2013.01); *G04C 5/005* (2013.01)

(58) Field of Classification Search
CPC ..... G04B 15/14; G04C 3/047; G04C 5/005; F16H 49/005; H02K 49/102
See application file for complete search history.

(56) References Cited

U.S. PATENT DOCUMENTS

2014/0319741 A1* 10/2014 Poffet ..... B29C 33/50 264/219
2017/0242403 A1* 8/2017 Di Domenico ..... G04C 5/005
(Continued)

FOREIGN PATENT DOCUMENTS

CH 710846 A2 9/2016
CN 101280803 B 6/2010
(Continued)

OTHER PUBLICATIONS

European Search Report of EP 19 21 7598 dated Jun. 18, 2020.
(Continued)

*Primary Examiner* — Edwin A. Leon
*Assistant Examiner* — Kevin Andrew Johnston
(74) *Attorney, Agent, or Firm* — Sughrue Mion, PLLC

(57) ABSTRACT

A method for manufacturing at least two mechanical parts to be arranged in a timepiece mechanism including magnetised functional areas having antagonistic polarities, the parts being arranged in a timepiece mechanism to cooperate with each other in relative displacement, the method including a step of constructing a blank of each of the two parts including at least one functional area from which the parts are able to cooperate with each other and a step of obtaining each of the parts including a sub-step of transforming said at least one functional area of the blank of each of these parts into a magnetised functional area from which emanates a magnetic field, at least one feature of which is configured so that this magnetic field participates in achieving a separation of the magnetised functional areas of the two parts when they are in a stop position in the mechanism.

8 Claims, 1 Drawing Sheet

(56) References Cited

U.S. PATENT DOCUMENTS

| | | | | |
|---|---|---|---|---|
| 2017/0329282 | A1* | 11/2017 | Theurillat-Bonjour | G04B 13/027 |
| 2021/0189278 | A1 | 6/2021 | Huot-Marchand | |

FOREIGN PATENT DOCUMENTS

| | | | | |
|---|---|---|---|---|
| CN | 101799111 | B | | 11/2011 |
| CN | 107092179 | A | | 8/2017 |
| CN | 107367920 | A | | 11/2017 |
| EP | 3 208 667 | A1 | | 8/2017 |
| JP | H02140058 | U | * | 11/1990 |
| JP | 2000-291779 | A | | 10/2000 |
| JP | 2000291779 | A | * | 10/2000 |
| JP | 2003-63424 | A | | 3/2003 |
| JP | 2005253292 | A | * | 9/2005 |
| JP | 2016-114508 | A | | 6/2016 |
| JP | 2016200228 | A | * | 12/2016 |
| JP | 2017-146300 | A | | 8/2017 |
| JP | 2017-223661 | A | | 12/2017 |
| WO | 98/15504 | A1 | | 4/1998 |
| WO | 2011/093091 | A1 | | 8/2011 |
| WO | 2016/020747 | A2 | | 2/2016 |
| WO | 2016/203063 | A1 | | 12/2016 |

OTHER PUBLICATIONS

Office Action dated Nov. 9, 2021 in Chinese Application No. 202011504555.1.

European Search Report of EP19217582.6 dated Jun. 24, 2020.

Notice of Reasons for Refusal dated Nov. 15, 2021 from the Japanese Patent Office in JP Application No. 2020-202436.

* cited by examiner

METHOD FOR MANUFACTURING AT LEAST TWO MECHANICAL PARTS

CROSS REFERENCE TO RELATED APPLICATION

This application claims priority to European Patent Application No. 19217598.2 filed Dec. 18, 2019, the entire contents of which are incorporated herein by reference.

TECHNICAL FIELD OF THE INVENTION

The invention relates to a method for manufacturing at least two mechanical parts intended to be arranged in a timepiece mechanism comprising magnetised functional areas having antagonistic polarities.

The invention also relates to a timepiece mechanism comprising at least two mechanical parts obtained according to such a manufacturing method. These mechanical parts are, for example, micromechanical and/or timepiece parts, typically a wheel, a plate, an anchor lever, a balance or else an axis.

PRIOR ART

In the field of timepiece mechanisms such as mechanical movements implementing mechanical parts in frictional contact and in relative displacement, it is known that such parts, obviously with the exception of the balance, are in a stop position the majority of the time, about 95% of the time. In this context, when these parts are stressed during the operation of this movement, the energy mobilised to displace these parts must be sufficient to overcome a particular type of friction called static friction.

Such a static friction results from adhesion forces established between the parts of this movement, in particular at their contact surface, when they are stopped. These adhesion forces can come, for example, from intermolecular forces such as the forces called Van der Waals forces (London, Keesom and Debye) which are essentially electrostatic in nature and result in particular from the establishment of hydrogen bonds of a partially covalent nature between the antagonistic contact surfaces of these parts. These adhesion forces can also come from intramolecular forces, of greater intensity than that of intermolecular forces, which can moreover lead to degradation of the surfaces of these parts. Such intramolecular forces can result from chemical elements which have been adsorbed by the antagonistic contact surfaces and which are then at the origin of the establishment of covalent bonds between these contact surfaces under the effect of pressure or due to the presence of a catalyst.

It will be noted that on a more macroscopic scale, the adhesions between these antagonistic contact surfaces are generally seen as capillary effects (for example adsorbed water or presence of lubricant in the contact) or as adhesion effects (for example micro-welds of asperities under the effect of pressure).

Under these conditions, it is understood that there is a need to find a solution which allows to limit or even eliminate such static friction in order to improve the operation of such mechanisms.

SUMMARY OF THE INVENTION

The invention therefore has the purpose of providing a method for manufacturing at least two mechanical parts intended to be arranged in a timepiece mechanism and capable of cooperating with each other in relative displacement and which have the particularity of avoiding the establishment of a bond/adhesion between their antagonistic contact surface when they are stopped.

To this end, the invention relates to a method for manufacturing at least two mechanical parts intended to be arranged in a timepiece mechanism comprising magnetised functional areas having antagonistic polarities, said parts being intended to be arranged in a mechanism, in particular a timepiece mechanism to cooperate with each other in relative displacement, the method comprising a step of constructing a blank of each of the two parts including at least one functional area from which said parts are able to cooperate with each other and a step of obtaining each of the parts including a sub-step of transforming said at least one functional area of the blank of each of these parts into a magnetised functional area from which emanates a magnetic field at least one feature of which is configured so that this magnetic field participates in achieving a separation of the magnetised functional areas of the two parts when they are in a stop position in the mechanism.

Thanks to such features, this method allows mechanical parts to be obtained intended to cooperate with each other in relative displacement and the antagonistic contact surfaces of which are separated when they are stopped, thus participating in reducing the energy consumption necessary to resume their displacement/movement. In this context, such parts then participate in increasing the overall efficiency of a timepiece mechanism such as a movement.

In other embodiments:

- the transformation sub-step comprises a phase of determining parameters of the magnetic field required for achieving said separation for each of said at least two parts from the estimation of at least one feature relating to this magnetic field depending on separation criteria of said at least two parts;
- the transformation sub-step comprises a phase of producing at least one channel in a portion of the blank body located in said at least one functional area, in particular below a functional contact surface comprised in said at least one area of each of said at least two parts;
- the production phase comprises a sub-phase of determining specificities of said at least one channel to be constructed in said at least one functional area depending on the determined parameters of the required magnetic field;
- the transformation sub-step comprises a phase of arranging in said at least one channel an amount of material developing a magnetic field depending on the determined parameters of the required magnetic field;
- the arrangement phase comprises a sub-phase of inserting a fluid, in particular a crosslinkable resin, comprising magnetic particles into said at least one channel;
- the arrangement phase comprises a sub-phase of magnetising the magnetic particles comprised in said fluid;
- the arrangement phase comprises a sub-phase of defining an orientation of the antagonistic polarity of the magnetic particles comprised in said fluid;
- the arrangement phase comprises a sub-phase of curing said fluid comprising the magnetic particles magnetised and provided with an oriented antagonistic polarity;
- the magnetisation, definition and curing sub-phases are carried out substantially simultaneously or simultaneously;
- the curing phase consists of a polymerisation by photocrosslinking and/or by chemical crosslinking;

the arrangement phase comprises a sub-phase of inserting a material developing a magnetic field comprising at least one permanent magnet into said at least one channel, and the arrangement phase comprises a sub-phase of mechanically holding said at least one permanent magnet in said at least one channel.

The invention also relates to a timepiece mechanism comprising at least two mechanical parts intended to cooperate with each other and able to be obtained by this method.

Advantageously, said mechanical parts comprise magnetised functional areas having antagonistic polarities.

In particular, the magnetised functional area of each of these parts is capable of generating a magnetic field the intensity of which is configured to ensure a separation of the magnetised functional areas of the two parts when these two parts are stopped in the mechanism.

BRIEF DESCRIPTION OF THE FIGURES

The purposes, advantages and features of the method for manufacturing a mechanical part according to the invention will become more apparent in the following description on the basis of at least one non-limiting embodiment illustrated by the drawings wherein.

DETAILED DESCRIPTION OF THE INVENTION

Figure 1:
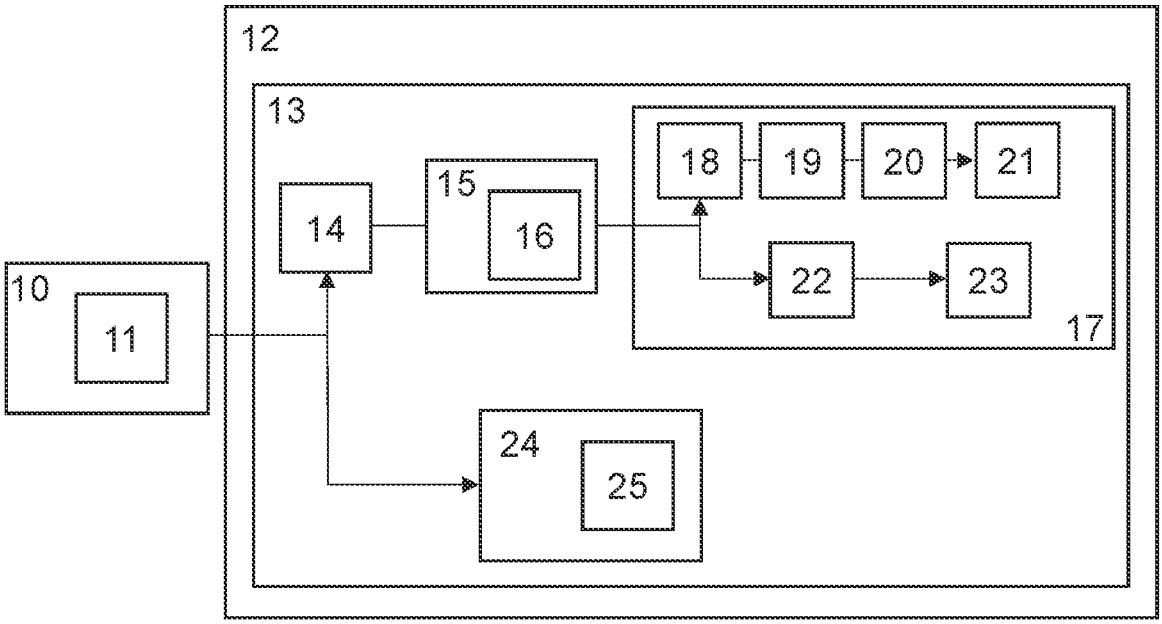
FIG. 1 is a flowchart showing the steps of a method for manufacturing at least two mechanical parts comprising magnetised functional areas having antagonistic polarities, according to one embodiment of the invention.

FIG. 1 shows a method for manufacturing at least two mechanical parts 1*a*, 1*b*, in particular micromechanical parts, comprising magnetised functional areas having antagonistic polarities. These parts 1*a*, 1*b* are specifically designed to cooperate with each other when they are assembled in a mechanism, at these functional areas 2*a*, 2*b*. Such parts are therefore defined to be arranged in this mechanism to cooperate with each other in relative displacement. Each functional area of each part comprises a surface 3*a*, 3*b* otherwise called functional contact surface 3*a*, 3*b*. A functional area 2*a*, 2*b* is therefore a portion of the body of a mechanical part 1*a*, 1*b* which differs from the other body portions of said part 1*a*, 1*b* in that this area 2*a*, 2*b* is specifically intended to participate in performing the expected function of this mechanical part 1*a* by cooperating for example with at least one functional area 2*a*, 2*b* of another mechanical part 1*b* when these parts 1*a*, 1*b* are constituent elements of a kinematic chain implemented in the mechanism. These parts 1*a*, 1*b* can also be, by way of example, mechanical parts 1*a*, 1*b* of a timepiece mechanism constituting all or part of a timepiece movement, and can therefore also be called "mechanical timepiece parts". Such mechanical timepiece parts 1*a*, 1*b* can each be a toothed wheel such as that illustrated in FIG. 2 or else an escapement wheel, an anchor or else any other pivoted parts such as shafts. In this context, when each of these two parts 1*a*, 1*b* is a wheel, then it comprises a functional contact surface 3*a*, 3*b* and an internal surface 4*a*, 4*b* preferably opposite the contact surface 3*a*, 3*b*, said surfaces 3*a*, 3*b*, 4*a*, 4*b* being separated from each other by a thickness referenced e of this wheel defined in this functional area 2*a*, 2*b*.

Such a method comprises a step 10 of constructing a blank of each of these two parts 1*a*, 1*b*, this blank including at least one functional area 2*a*, 2*b* from which said parts are able to cooperate with each other. In other words, the first part 1*a* comprises the functional area 2*a* provided with the contact surface 3*a* which is able, during a relative displacement, to cooperate with the contact surface 3*b* of the functional area 2*b* of the second mechanical part 1*b*. This step 10 of the method comprises a sub-step 11 of building a body of said blank of each part 1*a*, 1*b*. Such a sub-step 11 can for example provide for the implementation of an etching process of layers/substrates based, for example, on a material such as silicon in a manner similar to the process implemented in document WO9815504A1. This sub-step 11 can also alternatively provide for the production of this blank body for these two parts according to a process for manufacturing this blank body from a reinforced silicon according to the technology described in document CH701499A2. In another alternative, this sub-step 11 can also provide for the implementation of a three-dimensional printing technology for the production of this blank body, such as for example that described in document WO2019106407A1. This blank body of each part 1*a*, 1*b* is preferably made of a non-magnetic material and/or has a low or even zero magnetic permeability index. This material can be in a non-limiting and non-exhaustive manner:

Glass: fused silica, fused quartz, aluminosilicate, borosilicate, etc.

Materials in crystalline or polycrystalline form: Silicon, Germanium, Silicon carbide, Silicon nitride, quartz, etc.

Crystalline materials: ruby, sapphire, diamond, etc.

Ceramic and glass-ceramic materials.

Polymeric materials including organic glass such as polycarbonates or acrylics.

Metallic materials in crystalline or amorphous form.

Such a blank body relating to each mechanical part 1*a*, 1*b* has the shape as well as all the other features of the mechanical part 1*a*, 1*b* which will be obtained with the exception of the arrangements/modifications provided for this blank body for transforming said at least one functional area 2*a*, 2*b* into a magnetised functional area 2*a*, 2*b*. Thus in this context, the method therefore comprises a step 12 of obtaining each of these two mechanical parts 1*a*, 1*b* including a sub-step 13 of transforming said at least one functional area of the blank of each of these mechanical parts 1*a*, 1*b* into a magnetised functional area from which emanates a magnetic field at least one feature of which is configured so that this magnetic field participates in achieving a separation between the magnetised functional area 2*a* of the first part 1*a* and the magnetised functional area 2*b* of the first part 1*b* of the two parts when these two parts 1*a*, 1*b* assembled in the mechanism, are stopped, that is to say that they no longer cooperate with each other in relative displacement/movement. It is therefore understood that the functional areas 2*a*, 2*b* of these parts are specifically defined to participate in ensuring a controlled repulsion of these two mechanical parts 1*a*, 1*b* when they are in a stop position in the mechanism, so as to ensure separation between the contact surface 3*a* of the first part 1*a* and the contact surface 3*b* of the second part 1*b*.

For this purpose, this sub-step 13 comprises a phase 14 of determining parameters of the magnetic field required for achieving said separation and which is able to be generated by said at least one functional area 2*a*, 2*b* of each part 1*a*, 1*b*, from the estimation of at least one feature relating to this magnetic field depending on separation criteria of said at least two parts 1*a*, 1*b*. Such a phase 14 aims at defining the feature(s) of the magnetic field of the functional area 2*a*, 2*b* of each of the parts 1*a*, 1*b* which is required for the specific performance of a function aiming at ensuring the separation of the respective contact surfaces 3*a*, 3*b* of the functional areas 2*a*, 2*b* of the two mechanical parts 1*a*, 1*b* when the latter are assembled in the mechanism and stopped.

The features of this magnetic field relate for example to the intensity of the magnetic field and the distribution of this intensity relative to the functional area 2*a*, 2*b*, in particular relative to the contact surface 3*a*, 3*b*. Such an intensity and its distribution are determined for each of the two parts 1*a*, 1*b* in particular depending on the separation criteria of the two parts 1*a*, 1*b* comprising in a non-limiting and non-exhaustive manner the following information:

- the type/nature of this part, namely: its function in the mechanism, the material which constitutes it, its structural features (dimensions, weight, etc.);
- the type of mechanism wherein said part will be implemented;
- the type of cooperation it will have with the other part: by gearing, by friction;
- the type of relative movement/displacement between this part and the other part;
- the type/nature of the operation of this part in the mechanism;
- the type/nature of the other part with which the part is able to cooperate in the mechanism;
- the type/nature of the adhesive phenomenon/phenomena that this part is likely to encounter in its cooperation with the other part;
- the speeds of the two parts in the mechanism.

Once the configuration phase 14 has been carried out, the transformation sub-step 13 comprises a phase 15 of producing at least one channel 5 in a portion of the blank body of each part 1*a*, 1*b*, this portion being located in said at least one functional area 2*a*, 2*b* below the functional contact surface 3*a*, 3*b* comprised in said at least one functional area 2*a*, 2*b*. Such a phase 15 comprises a sub-phase 16 for determining the specificities of said at least one channel 5 to be constructed in said at least one functional area 2*a*, 2*b* depending on the determined required parameters of the magnetic field estimated during the preceding phase 14. These specificities of said at least one channel comprise the shape, the value of one section or several sections of this channel 5 if it comprises different sections, the extent of this channel 5 in the functional area relative to the contact surface 3*a*, 3*b* in particular the direction and/or sense wherein the channel extends in the area relative to the contact surface 3*a*, 3*b*, the location of this channel 5 relative to the contact surface 3*a*, 3*b*, and/or the location of each portion constituting this channel 5 relative to this contact surface. It will be noted that the definition of the extent and the location of all or part of this channel relative to the contact surface 3*a*, 3*b* means that this extent and this location depend on the distance present between this contact surface 3*a*, 3*b* and the channel 5 and/or depend on the length and/or width and/or the extent of this contact surface 3*a*, 3*b* of the functional area 2*a*, 2*b*

It will be noted that the channel 5 which is made for each part 1*a*, 1*b* in the thickness e of a portion of this blank body where the functional area 2*a*, 2*b* is located, and preferably has a small dimension. By way of example, the section of such a channel 5 has a surface area less than 25,000 $\mu m^2$, preferably less than 10,000 $\mu m^2$.

This phase 14 can provide for the formation of such a channel 5 from a femtosecond pulse laser, according to a technology described in document WO2019106407A1. This channel 5 is defined in the thickness e of the blank body of each part below the contact surface 3*a*, 3*b* of the functional area 2*a*, 2*b*.

Figure 2:
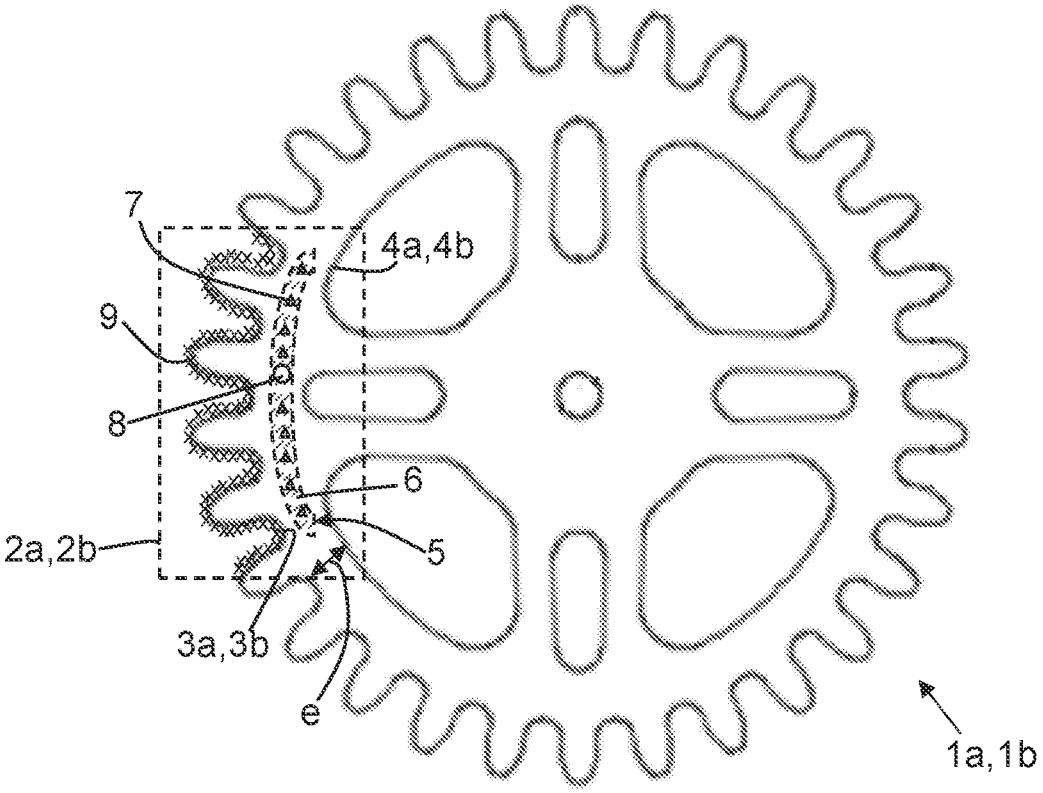
FIG. 2 is a schematic view of a variant of the two mechanical parts each comprising this said at least one magnetised/magnetic functional area, according to the embodiment of the invention.

Such a channel 5 comprises an opening 8 which is defined in the lateral face of the blank body comprised in the functional area 2*a*, 2*b* or in the internal surface 4*a*, 4*b* of this functional area 2*a*, 2*b*, this opening 8 connects an enclosure of this channel 5 to the external environment of the blank body. This lateral face interconnects the internal 4*a*, 4*b* and contact 3*a*, 3*b* surfaces of the functional area 2*a*, 2*b*. In the present embodiment, where the mechanical parts 1*a*, 1*b* illustrated in FIG. 2 is a wheel, this opening 8 is defined in the lateral face of the functional area 2*a*, 2*b* of the wheel. It will be noted that a plurality of channels 5 can be defined in the functional area 2*a*, 2*b*, thus forming a network of channels not shown in FIG. 2.

This transformation sub-step 13 then comprises a phase 17 of arranging in the enclosure of said at least one channel 5 an amount of material developing a magnetic field depending on the determined parameters of the magnetic field required during the preceding phase 14. During this phase 17, it is therefore understood that the amount of material arranged in this enclosure of the channel depends on the parameters of the magnetic field determined during phase 14. Such a material developing a magnetic field can comprise magnetic particles 7 comprised in a fluid 6 such as a polymer, such as for example Samarium-Cobalt or Neodymium-Iron-Boron or else ferromagnetic particles. This fluid 6 comprising these magnetic particles 7 is typically photosetting, thermosetting or else chemically setting. In other words, this fluid 6 can be a photosetting or thermosetting polymer, such as for example a crosslinkable epoxy resin. It will be noted that when the fluid 6 is chemically setting, then it comprises two components, a polymer such as epoxy resin and a polymerising agent, for example 1,4,7,10-tetraazadecane, for curing. In contact with these two components, a solid material, for example polyepoxide, is formed. This chemical curing works according to a principle similar to that of two-component adhesive Araldite™.

This phase 17 comprises a sub-phase 18 of inserting this fluid 6 comprising magnetic particles 7 into said at least one channel 5. During this sub-phase 18, the fluid 6 comprising these magnetic particles 7 is introduced via the opening 8 of said at least one channel 5 into the enclosure of the latter. Subsequently, this phase 17 comprises a sub-phase 19 of magnetising the magnetic particles 7 comprised in this fluid 6 and a sub-phase 20 of defining an orientation of the antagonistic polarity of the magnetic particles 7 comprised in said fluid 6. These two magnetisation 19 and definition 20 sub-phases are carried out from a permanent magnet which is then arranged near the functional area 2*a*, 2*b* comprising said channel 5 wherein the fluid 6 is comprised. By way of example, in this configuration, the permanent magnet can be arranged opposite the contact surface 3*a*, 3*b*. Thus, from this permanent magnet for one of the two parts, these magnetic particles 7 are then magnetised so that their polarity is oriented in a well-defined sense which is antagonistic to the sense of polarity of the other part. Antagonistic, should be understood here that the senses of polarity of the two parts 1*a*, 1*b* are such that they allow a repulsion of the latter to be ensured and in particular a separation of the contact surface 3*a*, 3*b* from their said at least one functional area 2*a*, 2*b* provided with magnetic particles 7. Then, the phase 17 comprises a sub-phase 21 of curing said fluid 6 comprising magnetic particles 7 magnetised and provided with an oriented antagonistic polarity. This curing sub-phase 21 consists of polymerisation by photo-crosslinking, thermo-crosslinking and/or by chemical crosslinking when the fluid 6 is a crosslinkable polymer. In other words, the crosslinking is carried out thermally by passage through an oven, heating by laser or else via electromagnetic radiation provided that the material constituting the blank body wherein said at least one channel 5 has been produced is transparent to the considered wavelengths. It is also possible to consider a chemical crosslinking via the use of two components such as a two-component adhesive operating according to the principle of the two-component adhesive Araldite™. It is also possible, depending on the choice of the resin used, for a natural crosslinking to be sufficient in the case, for example, where this resin comprises a solvent. Indeed, a brief moment in the open air is sufficient for the solvent to evaporate and for the resin to cross-link "by itself".

It will be noted that the magnetisation 19, definition 20 and curing 21 sub-phases are carried out simultaneously or substantially simultaneously.

In a variant of the method, the arrangement phase 17 may provide, as a replacement for the fluid 6 insertion 18, magnetisation 19, definition 20 and curing 21 sub-phases, the following phases:

- an sub-phase 22 of inserting a material developing a magnetic field comprising at least one permanent magnet into said at least one channel 5, and
- a sub-phase 23 of mechanically holding said at least one permanent magnet in said at least one channel 5.

During this insertion sub-phase 22, said at least one permanent magnet which is here a solid magnet, is arranged/placed/driven in the channel 5 so as to have a polarity oriented in a defined sense which is antagonistic, for one of the two parts, to the sense of polarity of the other part. During the mechanical holding sub-phase 23, said at least one permanent magnet is mechanically fastened to a wall of the enclosure of the channel 5 by gluing, welding, etc.

It will be noted that these two insertion 22 and mechanical holding 23 sub-phases can be carried out simultaneously as soon as this arrangement phase 17 is implemented by a three-dimensional printing process of said permanent magnet on the internal wall of the enclosure of the channel 5, for example using the technology known under the trademark Femtoprint™ described in document WO2019106407A1.

In another variant of the method, the transformation sub-step 13 can only comprise a phase 24 of applying a fluid comprising magnetic particles on the internal surface 4*a*, 4*b* of said at least one functional area 2*a*, 2*b*, arranged substantially opposite a functional contact surface 3*a*, 3*b* of this area 2*a*, 2*b* of each of the two parts 1*a*, 1*b*. This fluid is typically photosetting, thermosetting or else chemically setting. In other words, this fluid can be a photosetting or thermosetting polymer, such as for example a crosslinkable epoxy resin. It will be noted that when the fluid is chemically setting, then it comprises two components a polymer such as the epoxy resin and a polymerising agent, for example 1,4,7,10-tetraazadecane, for curing. In contact with these two components, a solid material, for example polyepoxide, is formed. This chemical curing works according to the principle of the two-component adhesive Araldite™. This application phase 24 can provide a sub-phase 25 of projecting at least one collimated or localised beam of fluid comprising magnetic particles on the internal surface 4 of the functional area 2*a*, 2*b*. This sub-phase 25 can be carried out in the form of a projection of a single beam of fluid on the internal surface 4. The beam is for example configured to project onto the internal surface 4*a*, 4*b* a continuous/discontinuous and localised bead of this fluid. Alternatively, the sub-phase 25 can be carried out in the form of a projection on the internal surface 4*a*, 4*b* of two collimated or localised beams. The first beam comprises the fluid containing the magnetic particles and the second beam comprises a liquid material selected so as to cause solidification of the fluid when it is contacted with the latter. As already mentioned previously, this is the principle of the two-component adhesive Araldite™, consisting of an epoxy resin comprising the magnetic particles 7 and a material such as a polymerising agent, 1,4,7,10-tetraazadecane. In contact with these two components, a polyepoxide is formed.

Thus, the invention allows at least two mechanical parts 1*a*, 1*b* to be obtained, the functional area 2*a*, 2*b* of which is magnetised while having antagonistic polarities. These functional areas 2*a*, 2*b* of these two parts 1*a*, 1*b* provided to cooperate together in the mechanism, are configured to generate a magnetic field which aims at ensuring a separation of the contact surfaces 3*a*, 3*b* of these areas 2*a*, 2*b* when these two parts 1*a*, 1*b* are stopped in this mechanism. Such a configuration of these contact surfaces when the two parts are stopped contributes in reducing the energy consumption of this mechanism when these parts 1*a*, 1*b* resume movement.

The invention claimed is:

1. A method for manufacturing at least two mechanical parts configured to be arranged in a timepiece mechanism comprising magnetized functional areas having antagonistic polarities, wherein the two mechanical parts cooperate with each other in relative displacement, the method comprising:

- a step of constructing a blank of each of the two parts including at least one functional area from which said parts are able to cooperate with each other; and
- a step of obtaining each of the parts including a sub-step of transforming said at least one functional area of the blank of each of these parts into a magnetized functional area from which emanates a magnetic field, at least one feature of which is configured so that this magnetic field participates in achieving a separation of the magnetized functional areas of the two parts when they are in a stop position in the mechanism, wherein the transformation sub-step comprises a producing phase of producing at least one channel in a portion of the blank body located in said at least one functional area below a functional contact surface comprised in said at least one area of each of said at least two parts, and an arrangement phase of arranging in said at least one channel an amount of material developing a magnetic field depending on the determined parameters of the required magnetic field, wherein the arrangement phase comprises: a sub-phase of inserting a fluid including a crosslinkable resin, comprising magnetic particles into said at least one channel; a sub-phase of magnetising the magnetic particles comprised in said fluid; a sub-phase of defining an orientation of the antagonistic polarity of the magnetic particles comprised in said fluid; and a sub-phase of curing said fluid comprising the magnetic particles magnetized and provided with an oriented antagonistic polarity, and wherein the magnetisation, definition and curing sub-phases are carried out substantially simultaneously or simultaneously.

2. The method according to claim 1, wherein the transformation sub-step comprises a phase of determining parameters of the magnetic field required for achieving said separation for each of said at least two parts from the estimation of at least one feature relating to this magnetic field depending on separation criteria of said at least two parts.

3. The method according to claim 1, wherein the producing phase comprises a sub-phase of determining specificities of said at least one channel to be constructed in said at least one functional area depending on the determined parameters of the required magnetic field.

4. The method according to claim 1, wherein the curing phase consists of a polymerisation by photo-crosslinking and/or by chemical crosslinking.

5. The method according to claim 1, wherein the arrangement phase comprises the following sub-phases:

inserting a material developing a magnetic field comprising at least one permanent magnet into said at least one channel;

mechanically holding said at least one permanent magnet in said at least one channel.

6. A timepiece mechanism comprising the at least two mechanical parts obtained by the method in accordance with claim 1.

7. The mechanism according to claim 6, wherein said mechanical parts comprise the magnetized functional areas having antagonistic polarities.

8. The mechanism according to claim 7, wherein the magnetized functional area of each of the parts is capable of generating the magnetic field the intensity of which is configured to ensure the separation of the magnetized functional areas of the two parts when the two parts are stopped in the mechanism.

* * * * *